US009583895B2

(12) United States Patent
Buck et al.

(10) Patent No.: US 9,583,895 B2
(45) Date of Patent: Feb. 28, 2017

(54) ELECTRICAL CONNECTOR INCLUDING ELECTRICAL CIRCUIT ELEMENTS

(71) Applicant: FCI Americas Technology LLC, Carson City, NV (US)

(72) Inventors: Jonathan E. Buck, Hershey, PA (US); Dana J. Bergey, Hershey, PA (US); Stephen B. Smith, Mechanicsburg, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 14/143,928

(22) Filed: Dec. 30, 2013

(65) Prior Publication Data

US 2014/0187089 A1 Jul. 3, 2014

Related U.S. Application Data

(60) Provisional application No. 61/746,984, filed on Dec. 28, 2012.

(51) Int. Cl.
*H01R 13/648* (2006.01)
*H01R 13/719* (2011.01)

(52) U.S. Cl.
CPC ..... *H01R 13/719* (2013.01); *Y10T 29/49208* (2015.01)

(58) Field of Classification Search
CPC .. H01R 13/71; H01R 13/646; H01R 13/6658; H01R 13/7195; H01R 13/6616
USPC ..... 439/607.07, 607.05, 620.01, 620.04, 439/620.06, 620.07, 620.09, 620.12, 439/620.15, 620.21
See application file for complete search history.

(56) References Cited

U.S. PATENT DOCUMENTS

| | | | | |
|---|---|---|---|---|
| 4,804,332 | A | 2/1989 | Pirc | |
| 5,702,258 | A | 12/1997 | Provencher et al. | |
| 7,331,800 | B2 | 2/2008 | Winings et al. | |
| 7,540,781 | B2 | 6/2009 | Kenny et al. | |
| 7,666,009 | B2 * | 2/2010 | Minich | H01R 13/443 439/101 |
| 7,914,303 | B2 * | 3/2011 | Amleshi et al. | 439/82 |
| 8,062,070 | B2 | 11/2011 | Jeon et al. | |
| 8,062,073 | B1 | 11/2011 | Szczesny et al. | |
| 8,123,563 | B2 | 2/2012 | Kenny et al. | |
| 8,771,016 | B2 * | 7/2014 | Atkinson et al. | 439/607.07 |
| 2005/0287869 | A1 | 12/2005 | Kenny et al. | |
| 2010/0035470 | A1 | 2/2010 | Liu et al. | |
| 2010/0240233 | A1 | 9/2010 | Johnescu et al. | |

(Continued)

FOREIGN PATENT DOCUMENTS

| | | |
|---|---|---|
| EP | 1 496 578 A | 1/2005 |
| WO | WO 2012/041746 | 4/2012 |

OTHER PUBLICATIONS

Extended European Search Report for European Application No. 13867774.5 dated Sep. 27, 2016.

*Primary Examiner* — Amy Cohen Johnson
*Assistant Examiner* — Milagros Jeancharles
(74) *Attorney, Agent, or Firm* — Wolf, Greenfield & Sacks, P.C.

(57) ABSTRACT

An electrical connector includes a plurality of leadframe assembly, each having a leadframe housing and a plurality of contacts carried by the leadframe housing. The electrical connector includes at least one unassigned electrical contact that includes a resistor.

23 Claims, 8 Drawing Sheets

(56) References Cited

U.S. PATENT DOCUMENTS

| | | | | |
|---|---|---|---|---|
| 2011/0159473 | A1* | 6/2011 | Crighton et al. | 434/379 |
| 2011/0287663 | A1* | 11/2011 | Gailus et al. | 439/620.21 |
| 2011/0318945 | A1 | 12/2011 | De Geest et al. | |
| 2012/0184141 | A1 | 7/2012 | Mattson | |

* cited by examiner

ELECTRICAL CONNECTOR INCLUDING ELECTRICAL CIRCUIT ELEMENTS

CROSS-REFERENCE TO RELATED APPLICATIONS

This application claims the benefit of U.S. Provisional Application No. 61/746,984 filed Dec. 28, 2012, the disclosure of which is hereby incorporated by reference as if set forth in its entirety herein.

TECHNICAL FIELD

The present disclosure relates generally to the field of electrical connectors, and in particular relates to an electrical connector that is configured to reduce cross-talk between adjacent signal contacts.

BACKGROUND

Electrical connectors provide signal connections between electronic devices using electrically-conductive contacts, or electrical contacts. In some applications, an electrical connector provides a connectable interface between one or more substrates, e.g., printed circuit boards. Such an electrical connector may include a receptacle connector mounted to a first substrate and a complementary header connector mounted to a second substrate. Typically, a first plurality of electrical receptacle contacts in the receptacle connector is adapted to mate with a corresponding plurality of electrical header contacts in the header connector. For instance, the electrical receptacle contacts can receive the electrical header contacts so as to establish an electrical connection between the electrical receptacle contacts and the electrical header contacts.

The electrical contacts typically include a plurality of signal contacts S and ground contacts G. Often, the signal contacts are so closely spaced that undesirable interference, or "cross talk," occurs between adjacent signal contacts. Cross talk occurs when one signal contact, which can be referred to as an aggressor signal contact, induces electrical interference in an adjacent signal contact, which can be referred to as a victim signal contact, due to intermingling electrical fields, thereby compromising signal integrity. With electronic device miniaturization and high speed, high signal integrity electronic communications becoming more prevalent, the reduction of cross talk becomes a significant factor in connector design.

SUMMARY

In accordance with one embodiment, an electrical connector is configured to transmit electrical signals. The electrical connector can include an electrically insulative connector housing, and a plurality of electrical contacts supported by the connector housing. The electrical contacts can be arranged in a plurality of rows that extend along a row direction, and a plurality of columns that extend along a column direction that is substantially perpendicular to the row direction. The plurality of electrical contacts can include at least one pair of electrical signal contacts and at least one select electrical contact. At least one of the pair of electrical signal contacts can include a first portion that carries a mating end, a second portion that carries a mounting end, and a respective capacitor electrically coupled between the first and second portions. The at least one select electrical contact can include a first portion, a second portion, and a resistor electrically coupled between the first and second portions.

BRIEF DESCRIPTION OF THE DRAWINGS

The foregoing summary, as well as the following detailed description of an example embodiment of the application, will be better understood when read in conjunction with the appended drawings. For the purposes of illustrating various embodiments of the present disclosure, there is shown in the drawings an example embodiment. It should be understood, however, that the application is not limited to the precise arrangements and instrumentalities shown. In the drawings.

DETAILED DESCRIPTION

Figure 1A:
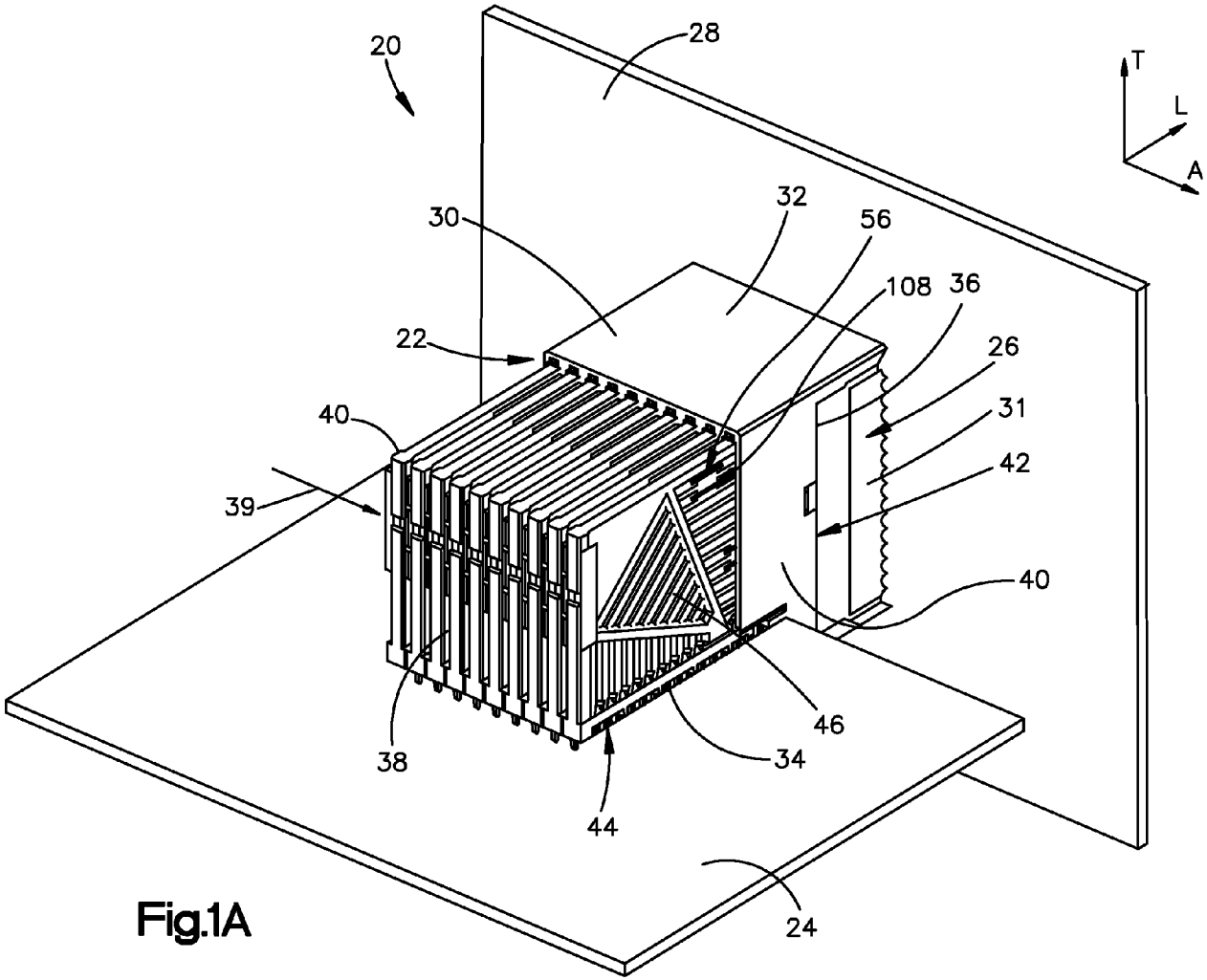
FIG. 1A is a perspective view of an electrical connector assembly including a first electrical connector and a second electrical connector, shown mounted to respective printed circuit boards and mated to each other so as to place the printed circuit boards in electrical communication with each other.
Figure 1B:
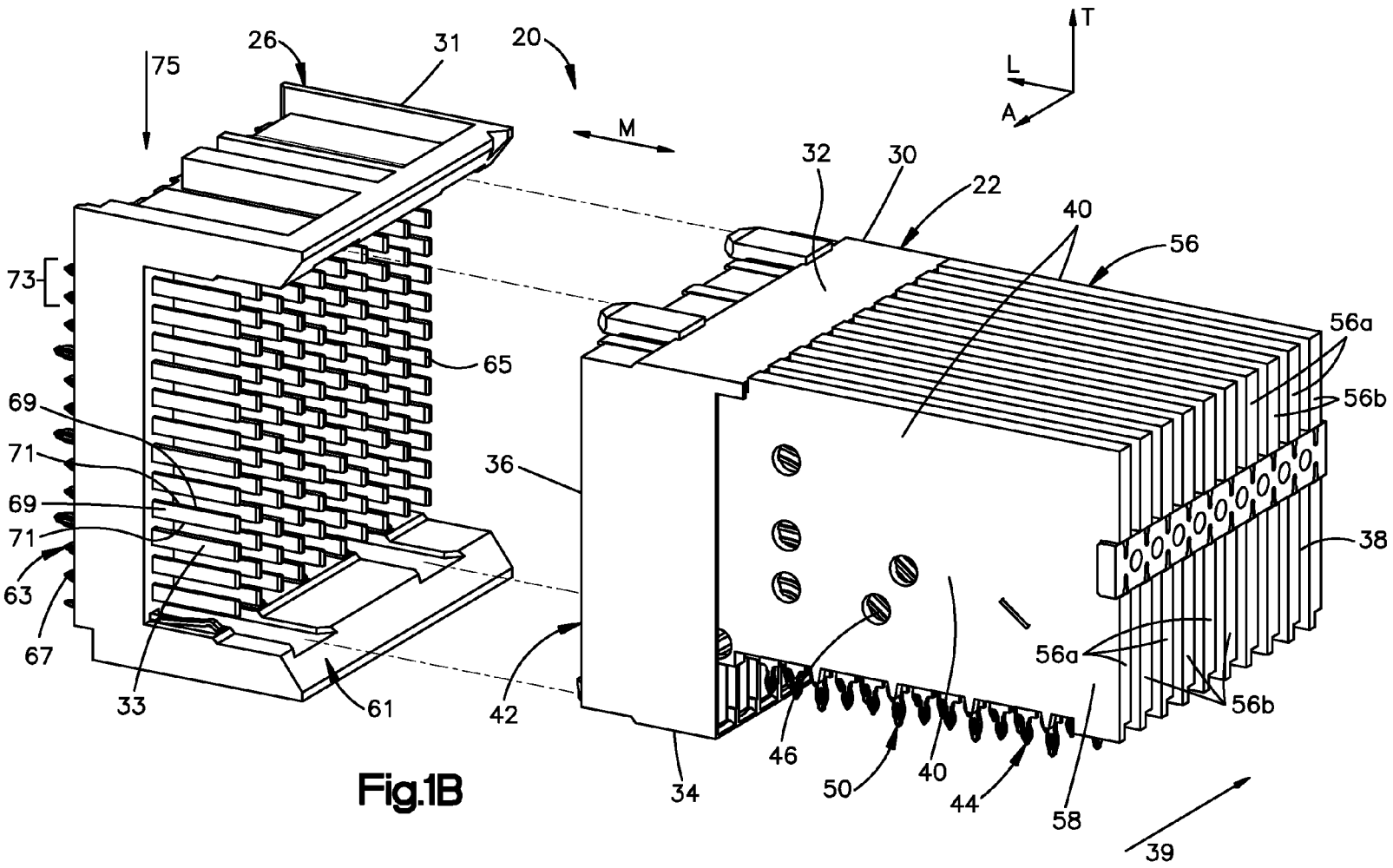
FIG. 1B is an exploded perspective view of the electrical connector assembly illustrated in FIG. 1A, showing the first and second electrical connectors aligned to be mated with each other.
Figure 1C:
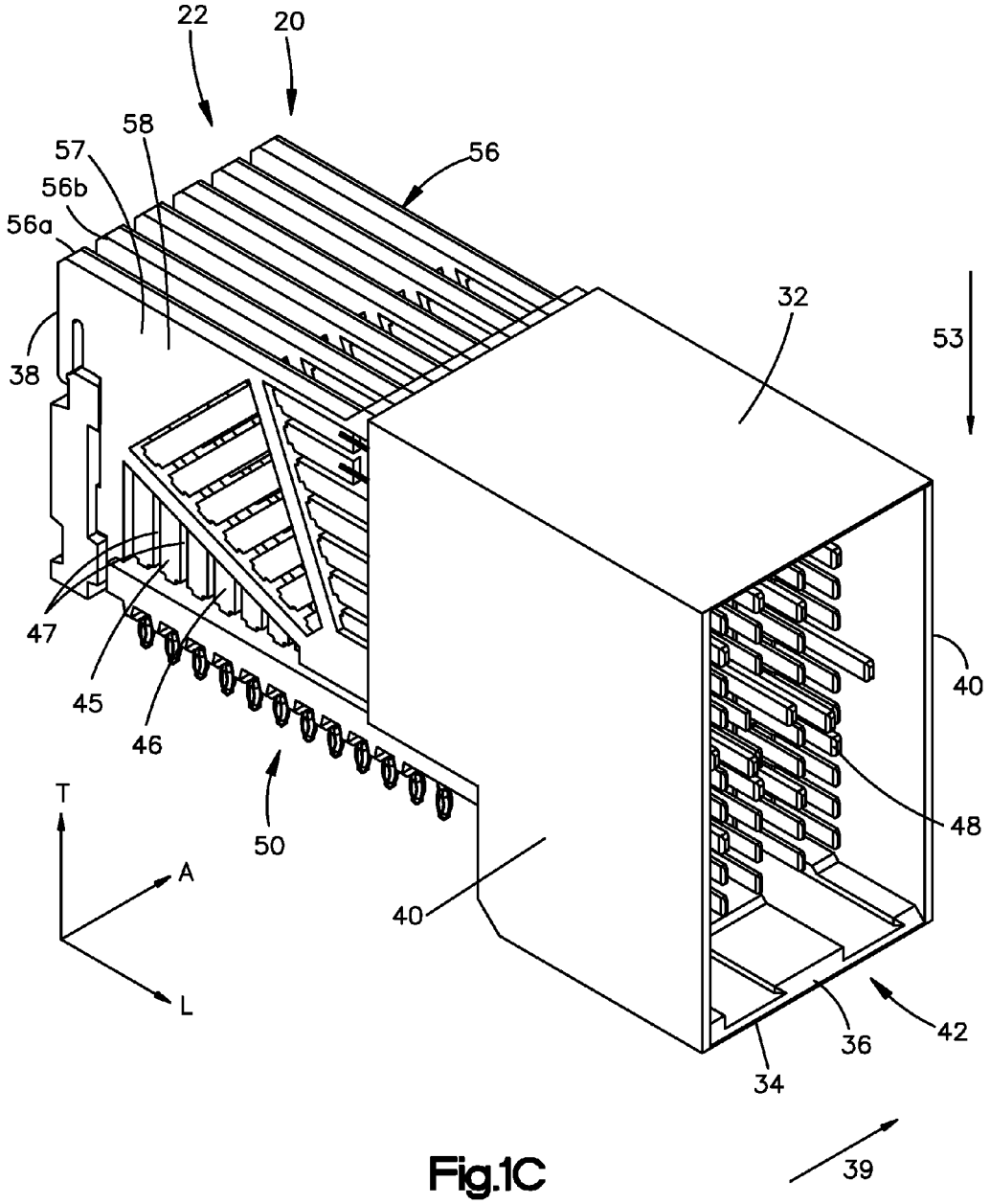
FIG. 1C is a perspective view of the first electrical connector illustrated in FIG. 1A.

Referring to FIGS. 1A-C, an electrical connector system 20 includes a first electrical connector 22 and a second electrical connector 26. The first and second electrical connectors 22 and 26 are configured to mate with each other so as to place the first and second electrical connectors in electrical communication with each other. The first electrical connector 22 is configured to be mounted to a first complementary electrical component which can be configured as a first substrate 24 that can define a printed circuit board. Similarly, the second electrical connector 26 is configured to be mounted to a second complementary electrical component which can be configured as a second substrate 28 that can define a printed circuit board. When the first and second electrical connectors 22 and 26 are mounted to the respective first complementary and second electrical components and mated with each other, the first complementary and second electrical components are placed in electrical communication with each other.

The first electrical connector 22 includes a connector housing 30 that is dielectric or electrically insulative. Housing 30 may also be made from a frequency absorber, such as an electrically conductive or electrically insulative lossy material. The connector housing 30 defines a top end 32 and an opposed bottom end 34, a front end 36 and an opposed rear end 38, and opposed sides 40. The opposed front and rear ends 36 and 38 are spaced apart along a longitudinal direction L. The front end 36 is spaced from the rear end 38 in a forward direction, and the rear end 38 is spaced from the front end 36 in a rearward direction. The opposed sides 40 are spaced apart along a lateral direction A that is substantially perpendicular with respect to the longitudinal direction L, and the top and bottom ends 32 and 34 are spaced apart along a transverse direction T that is substantially perpendicular with respect to the lateral direction A and the longitudinal direction L. The top end 32 is spaced from the bottom end 34 along an upward direction, and the bottom end 34 is spaced from the top end 32 in a downward direction. Thus, it should be appreciated that, as illustrated, the transverse direction T is oriented vertically, and the longitudinal and lateral directions L and A are oriented horizontally, though it should be appreciated that the orientation of the first electrical connector 22 may vary during use. In accordance with the illustrated embodiment, the first and second electrical connectors 22 and 26 are configured to be mated with each other along a mating direction M, which can extend along the longitudinal direction L.

The first electrical connector 22 includes a plurality of electrical contacts 46 that are electrically conductive and supported by the connector housing 30. The electrical contacts 46 define mating ends 48 that are configured to mate, and thus be placed in electrical communication, with complementary ones of the electrical contacts of the second electrical connector 26 when the first and second electrical connectors 22 and 26 are mated with each other. The electrical contacts 46 further define mounting ends 50 that are configured to be placed in electrical communication with the first complementary electrical component, such as the first substrate 24. The mounting ends 50 may be press-fit tails, surface mount tails, or fusible elements such as solder balls, which are configured to electrically connect to a complementary electrical component such as the first substrate 24, which can be configured as a backplane, midplane, daughtercard, or the like.

The connector housing 30 defines a mating interface 42 that is configured to engage the mating interface of the second electrical connector 26 when the first and second electrical connectors 22 and 26 are mated to each other, and a mounting interface 44 that is configured to operatively engage the first substrate 24 when the first electrical connector 22 is mounted to the first substrate 24. The mating ends 48 of the electrical contacts 46 can be disposed proximate to the mating interface 42, and the mounting ends 50 of the electrical contacts 46 can be disposed proximate to the mounting interface 44. The mating interface 42 can be configured to receive the mating interface of the second electrical connector 26, or can be configured to be received by the mating interface of the second electrical connector 26. The mating interface 42 is configured such that the mating ends 48 of the electrical contacts 46 are placed in electrical communication with complementary ones of the electrical contacts of the second electrical connector 26 when the first and second electrical connectors 22 and 26 are mated with each other. The mounting interface 44 is configured to operatively engage the first substrate 24 so that the mounting ends 50 of the electrical contacts are placed in electrical communication with the first substrate 24 when the first electrical connector 22 is mounted to the first substrate 24.

As shown, the first electrical connector 22 can be a right-angle electrical connector, whereby the mating interface 42 and the mounting interface 44 are oriented substantially perpendicular to each other. Further, the mating ends 48 of the electrical contacts 46 and the mounting ends 50 of the electrical contacts 46 are oriented substantially perpendicular to each other. Thus, the electrical contacts 46 can be referred to as right-angle electrical contacts. In accordance with one embodiment, the mating interface 42 can be disposed proximate to the front end 36 and the mounting interface 44 can be disposed proximate to the bottom end 34. Thus, the mating interface 42 can extend generally along a plane that extending along the lateral direction A and the transverse direction T. The mounting interface 44 can extend generally along a plane that includes the longitudinal direction L and the lateral direction A. Alternatively, it should be appreciated that the first electrical connector 22 can be configured as a vertical connector whereby the mating interface 42 and the mounting interface 44 are oriented substantially parallel to each other. For instance, the mating interface 42 can be disposed proximate to the front end 36 as described above, and the mounting interface 44 can be disposed proximate to the rear end 38. Thus, the mounting interface can extend generally along a plane that extending along the lateral direction A and the transverse direction T. Similarly, the electrical contacts 46 can be configured as vertical electrical contacts whereby the mating ends 48 are oriented substantially parallel with respect to the mounting ends 50.

Figure 2A:
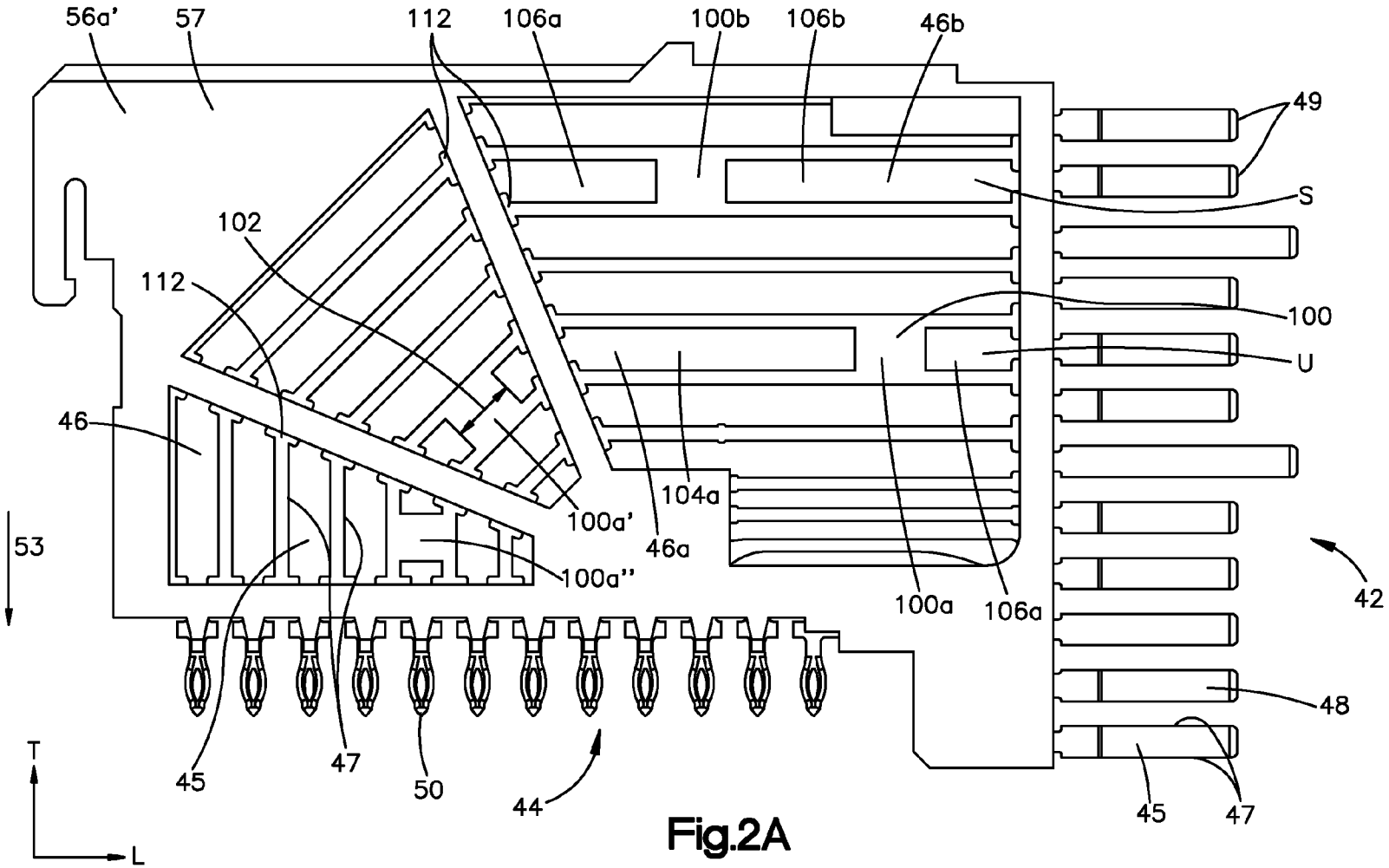
FIG. 2A is a side elevation view of a partially constructed leadframe assembly of the first electrical connector illustrated in FIG. 1A.
Figure 2B:
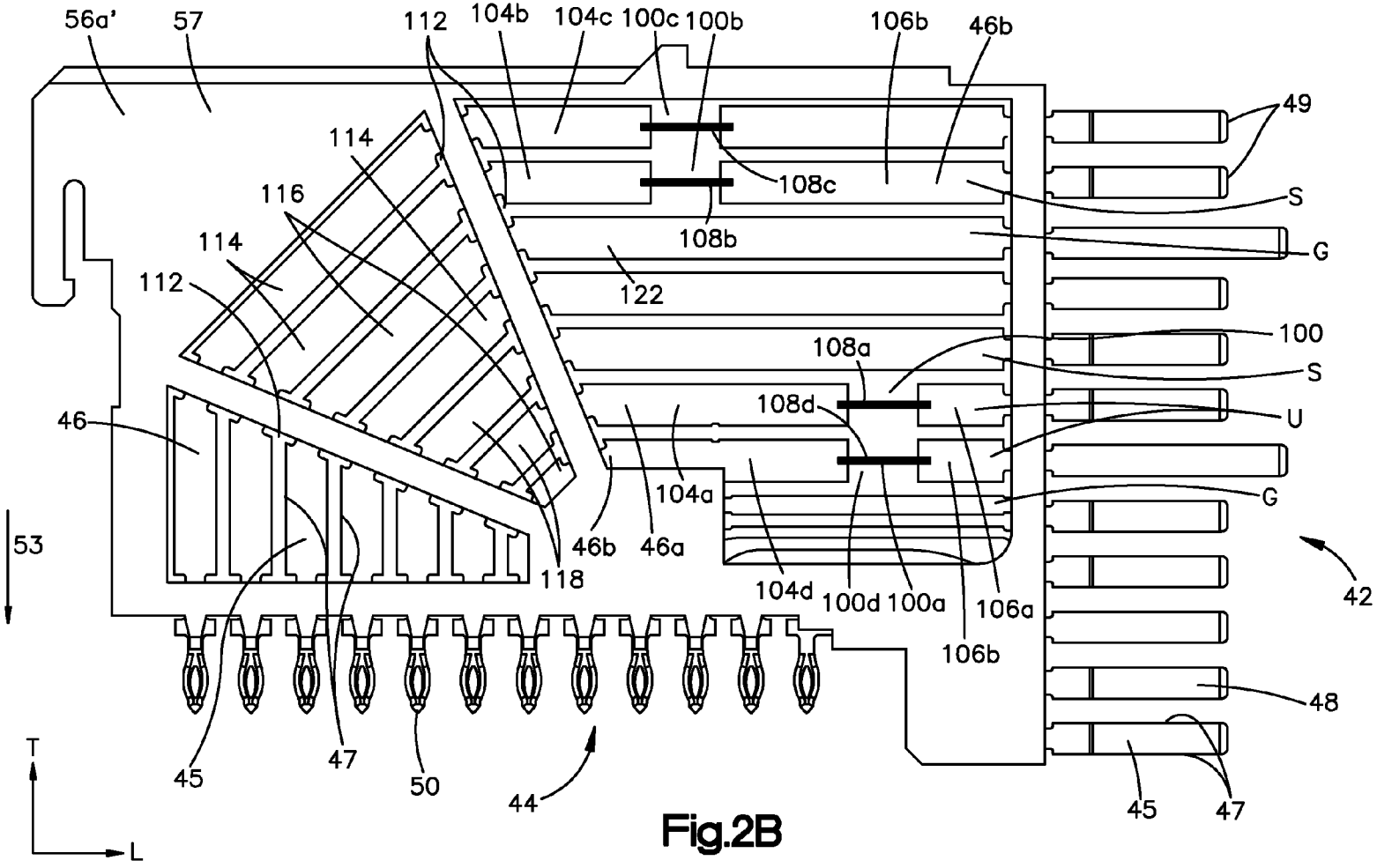
FIG. 2B is a side elevation view of the leadframe assembly illustrated in FIG. 2A, but shown fully constructed.
Figure 2C:
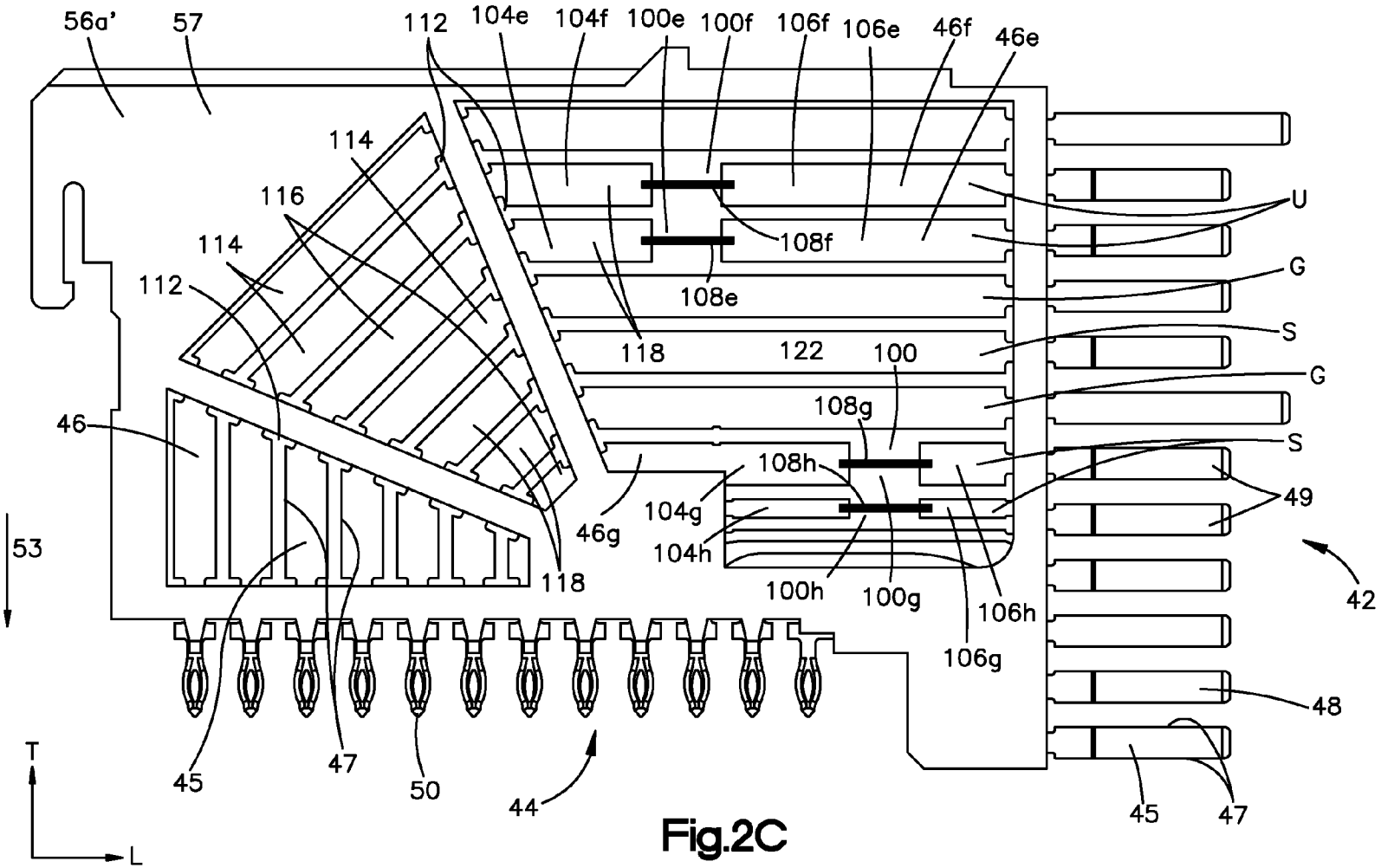
FIG. 2C is a side elevation view of a second leadframe assembly of the electrical connector illustrated in FIG. 1A.

In accordance with the illustrated embodiment, the first electrical connector 22 includes a plurality of leadframe assemblies 56 that are supported by the connector housing 30 and arranged along a laterally extending row direction 39. The housing 30 may have vertical ribs that separate adjacent leadframe assemblies 56, or may be devoid of the ribs. Referring also to FIGS. 2A-2C, each leadframe assembly 56 can include a leadframe housing 58 that can be a dielectric or electrically insulative material. The leadframe housings 58 may also be made from a frequency absorber, such as an electrically conductive or electrically insulative lossy material. Each leadframe assembly 56 can further include select ones of the plurality of electrical contacts 46 that are supported by the respective leadframe housing 58. In accordance with one embodiment, the leadframe assemblies 56 can be insert molded leadframe assemblies (IMLAs) whereby the respective electrical contacts 46 are overmolded by the corresponding leadframe housing 58. Alternatively, the electrical contacts 46 can be stitched or otherwise fixed in the respective leadframe housing 58.

The electrical contacts 46 of each of the leadframe assemblies 56 can be arranged at the mating interface 42 along respective columns 53 that extend along the transverse direction T. The columns 53 can be spaced from each other along the row direction 39. Thus, the electrical contacts 46 of adjacent leadframe assemblies 56 are arranged in adjacent parallel columns 53. The leadframe housing 58 of each leadframe assembly 56 defines laterally opposed first and second outer surfaces 55 and 57 that are spaced apart along the row direction 39. Accordingly, the first outer surface 55 of the leadframe housing 58 of a first one of the leadframe assemblies 56 faces the second outer surface 57 of a the leadframe housing 58 of a second one of the leadframe assemblies 56 that is adjacent the first one of the leadframe assemblies 56. The first one of the leadframe assemblies 56 can be included in a plurality of first leadframe assemblies 56*a* (see FIG. 2B) or a plurality of second leadframe assemblies 56*b* (see FIG. 2C), and the second one of the leadframe assemblies 56 can included in the other of the plurality of first leadframe assemblies 56*a* and the second plurality of leadframe assemblies 56*b*, as described in more detail below.

The plurality of leadframe assemblies 56 can include, for example, at least one first leadframe assembly, such as a plurality of first leadframe assemblies 56*a* as illustrated in FIG. 2B, and at least one second leadframe assembly, such as a plurality of second leadframe assemblies 56*b* as illustrated in FIG. 2C. Thus, one or more of the first leadframe assemblies 56*a*' and one or more of the second leadframe assemblies 56*b*' may be arranged so as to form at least part of the first electrical connector 22. The first leadframe assemblies 56*a* and the second leadframe assemblies 56*b* can be alternatingly arranged along the row direction 39. Thus, each of the first leadframe assemblies 56*a* can be disposed between a pair of second leadframe assemblies 56*b* or adjacent one of the second leadframe assemblies 56*b*. Likewise, each of the second leadframe assemblies 56*b* can be disposed between a pair of first leadframe assemblies 56*a* or adjacent one of the first leadframe assemblies 56*a*. As used herein, the term "adjacent" can refer to contacts (or rows or columns) that are next to one another. Each of the plurality of first leadframe assemblies 56*a* can have a first electrical contact arrangement, and each of the plurality of second leadframe assemblies 56*b* can have a second electrical contact arrangement that differs from the first contact arrangement of each of the plurality of first leadframe assemblies 56*a*. Alternatively, the first and second leadframe assemblies 56*a* and 56*b* can define the same arrangement of electrical contacts.

Each of the electrical contacts 46 can define respective first and second opposed broadsides 45 and first and second edges 47 connected between the broadsides. The edges 47 define a length less, and each of the broadsides 45 defines a length that is greater than that of the broadsides 45, such that the electrical contacts 46 define a rectangular cross section. For instance, the lengths of the broadsides 45 and the edges 47 can be defined at the mating end 48 along a plane that includes the transverse direction T and the lateral direction A. Thus, the broadsides 45 can extend along the transverse direction T at the mating end 48, and the edges 47 can extend along the lateral direction A at the mating end 48. The mating ends 48 of the electrical contacts 46 can configured as receptacles that receive mating ends of electrical contacts of the second complementary electrical connector 26. Alternatively, that the mating ends 48 are configured as plugs that are received by the electrical contacts of the second complementary electrical connector 24.

The electrical contacts 46 can include a plurality of signal contacts S that are configured to carry and transmit data signals between the first substrate 22 and the second electrical connector 26, and a plurality of ground contacts G that can be positioned adjacent a select one or select ones of the signal contact S. Any suitable dielectric material, such as air or plastic, may be used to isolate the electrical contacts 46 of one leadframe assembly 56 from the electrical contacts 46 of an adjacent one of the leadframe assemblies 56. At least one or more pairs of adjacent signal contacts S can define a differential signal pair 49, or the signal contacts S can be single-ended as desired. In accordance with one embodiment, the differential signal pairs 49 are edge coupled, that is edges 47 of each signal contact S of a given differential pair 49 face each in each of the leadframe assemblies 56. Thus, the first electrical connector 22 can include a plurality of differential signal pairs 49 arranged along the columns 53. The first electrical connector 22 can include any number of differential signal pairs 49 positioned edge-to-edge along the respective columns 53, though the first electrical connector 22 can include any number of differential signal pairs along a given column as desired, such as two, three, four, five, six, or more differential signal pairs.

In accordance with another embodiment, the differential signal pairs 49 may be broadside coupled, that is the broadside 45 of each electrical contact 46 of a given differential pair 49 face each other along the column 53. Thus, the first electrical connector 22 can include a plurality of broadside coupled differential signal pairs 49 arranged along a given column 53. The first electrical connector 22 can include any number of differential signal pairs 49 positioned broadside-to-broadside along the respective columns 53, though the first electrical connector 22 can include any number of differential signal pairs along a given column as desired, such as two, three, four, five, six, or more differential signal pairs. Alternatively still, it should be appreciated that the differential signal pairs 49 can alternatively be broadside coupled, such that the broadsides of the signal contacts S of adjacent leadframe assemblies 56 along the row direction 39 face each other and define differential signal pairs.

As described above, the electrical contacts 46 can include a plurality of signal contacts S and a plurality of ground contacts G. Further, as described above, the plurality of leadframe assemblies 56 can include at least one first leadframe assembly 56*a*, such as a plurality of first leadframe assemblies 56*a*, and at least one second leadrrame assembly 56*b*, such as a plurality of second leadframe assemblies 56*b*. The plurality of first and second leadframe assemblies 56*a* can be alternatingly arranged along the row direction, such that one of the first leadframe assemblies 56*a* defines an outermost one of the leadframe assemblies at one of the sides 40, and one of the second leadframe assemblies 56*b* defines an outermost one of the leadframe assemblies at the other of the sides 40. The plurality of first and second leadframe assemblies 56*a* and 56*b* can be alternatively arranged as desired. Each of the first and second pluralities of leadframe assemblies 56*a* and 56*b* can be constructed as described above, but can support the electrical contacts 46 in different contact arrangements. For instance, each of the plurality of first leadframe assemblies 56*a* can define a first contact arrangement, and each of the plurality of second leadrrame assemblies 56*b* can define a second contact arrangement that is different than the first contact arrangement.

In accordance with one embodiment, each of the plurality of first leadframe assemblies 56*a* can define a signal contact S at the electrical contact 46 whose mating end 48 the uppermost mating end 48 of all of the electrical contacts of the respective leadframe assembly 56, and whose mounting end 50 is at the rearmost mounting end 50 of all of the electrical contacts 46 of the respective leadrrame assembly 56. The first arrangement of electrical contacts 46 of each of the first plurality of leadframe assemblies 56*a* can define a repeating S-S-G pattern along a downward direction from the top of the respective leadframe housing 58 toward the bottom of the respective leadframe housing 58 at the mating interface 42. Furthermore, each of the plurality of second leadframe assemblies 56*a* can define a ground contact G at the electrical contact 46 whose mating end 48 the uppermost mating end 48 of all of the electrical contacts of the respective leadframe assembly 56, and whose mounting end 50 is at the rearmost mounting end 50 of all of the electrical contacts 46 of the respective leadrrame assembly 56. The second arrangement of electrical contacts 46 of each of the plurality of second leadframe assemblies 56*b* can define a repeating G-S-S pattern along a downward direction from the top of the respective leadframe housing 58 toward the bottom of the respective leadframe housing 58 at the mating interface 42.

Thus, the first and second contact arrangements can define different patterns of signal contacts S and ground contacts G. Alternatively, the first and second leadframe assemblies 56*a-b* can define the same pattern of signal contacts S and ground contacts G. It should be further appreciated that the mating interface 42 can define an open pin field, such that the electrical contacts 46 of each of the plurality of first and second leadframe assemblies 56 are unassigned. Thus, the ground contacts G can alternatively be provided as signal contacts that can have a data transfer speed that is different (for instance less) than that of the signal contacts S. Thus, reference herein to contacts G is made for illustrative purposes only, it being appreciated that the contacts G can be ground contacts as described above, or can alternatively provide signal contacts during operation. Furthermore, one or more of the signal contacts S, and thus one or more pairs of adjacent signal contacts S of one or more up to all of the plurality of first leadframe assemblies 56*a* can be unassigned electrical contacts U that are configured to carry signal transmissions but are not intended to carry signal transmissions. Similarly, one or more of the signal contacts S, and thus one or more pairs of adjacent signal contacts S of one or more up to all of the plurality of second leadframe assemblies 56*b* can be unassigned electrical contacts U that are configured to carry signal transmissions but are not intended to carry signal transmissions. Thus, it should be appreciated that certain of the electrical contacts 46 of each of the first and second leadframe assemblies 56*a* and 56*b* can be referred to as non-ground electrical contacts, in that the non-ground electrical contacts can be configured as unassigned electrical contacts U or signal contacts S. Further still, the first electrical connector 22 may contain a plurality of third leadframe assemblies having a third contact pattern that is different than each of the first and second contact patterns.

It should be appreciated that the location of unassigned U contacts may be located in a wide variety of locations. For example, it should be appreciated that the first and second leadframe assemblies 56*a* and 56*b* of the first electrical connector 22 can include an arrangement of electrical contacts in any contact pattern along the column direction as desired 53. Further, it should be appreciated that a select one or more of the first and second leadframe assemblies 56*a* and 56*b* may be devoid of unassigned electrical contacts U, and an adjacent other of the first and second leadframe assemblies 56*a* and 56*b* can include an unassigned electrical contact U. Additionally, a differential signal pair 49 may be located adjacent to one or more unassigned electrical contacts U along the row direction 39 or the column direction 53. For example, the differential signal pair 49 may be adjacent to a first pair of unassigned electrical contacts U and a second pair of unassigned electrical contacts U in one or both of the row direction 39 and the column direction 53.

As depicted in FIG. 2A, contacts G may be ground contacts. In an embodiment, one or more of ground contacts G of the first and second leadframe assemblies 56*a* and 56*b* may extend forward from the leadframe housing 58 along the longitudinal direction so as to terminate at a location forward with respect to the signal contacts S of the respective leadframe assembly 56. This may be desired so that one or more of the ground contacts G make contact with complementary ground contacts G of the second electrical connector 26 before the signal contacts S make contact with the complementary signal contacts S of the second electrical connector 26, thus bringing the leadframe assembly 56 (and first electrical connector 22, of which the leadframe assembly 56 may be a part of) to ground before the signal contacts are mated. Further, the signal contacts S are removed from complementary signal contacts S of the second electrical connector 26 before one or more the ground contacts G are removed from the complementary ground contacts G of the second electrical connector 26 when the first and second electrical connectors 22 and 26 are unmated from each other.

Referring to FIGS. 2A-2B, a fabrication steps are illustrated for constructing an illustrative one of the plurality of first leadframe assemblies 56*a*' that includes at least one or more select unassigned electrical contacts U. The unassigned electrical contacts U may be an electrical contact 46 which is able to carry a signal transmission but is not intended to carry any such transmissions. Stated differently, the unassigned electrical contacts U are not used for signal transmission and can therefore be referred to as an unused contact. As will be explained in further detail below, unassigned electrical contacts U may be selected in order to reduce insertion loss spikes at the signal contacts S during operation of the first electrical connector 22. In accordance with one embodiment, one or more up to all of the unassigned electrical contacts U may extend between the mating interface 42 and a mounting interface 44 and can include a mating end 48 but not a mounting end 50. In accordance with one embodiment, one or more up to all of the unassigned electrical contacts U may extend between the mating interface 42 and a mounting interface 44 and can include a mounting end 50 but not a mating end 48. In accordance with one embodiment, one or more up to all of the unassigned electrical contacts U may extend between the mating interface 42 and a mounting interface 44 and can include both a mating end 48 and a mounting end 50. In accordance with one embodiment, one or more up to all of the unassigned electrical contacts U may extend between the mating interface 42 and a mounting interface 44 and can include neither a mounting end 50 nor a mating end 48.

Once the one or more of the electrical contacts 46 are identified to be unassigned electrical contacts U, at least one gap 100, for instance a plurality of gaps 100, can be created in one or more of the identified electrical contacts 46 anywhere along their respective lengths. For instance, one or more, up to all, of the electrical contacts 46 can define a respective first portion 104, a second portion 106, and third portion that extends between the first and second portions 104 and 106. The first portion 104 can be disposed proximate to the mating interface 48 when the corresponding leadframe assembly 56 is supported by the connector housing 30. The second portion 106 can be disposed proximate to the mounting interface 50 when the corresponding leadframe assembly 56 is supported by the connector housing 30, and the third portion can be disposed between the first portion 104 and the second portion 106. Thus, the mating portion 48 can extend from the first portion 104, and the mounting portion 50 can extend from the second portion 106 in embodiments whereby the electrical contacts 56 include a mating end and mounting end, respectively. The first portion 104 can be oriented along the longitudinal direction L, the second portion 106 can be oriented along the transverse direction T, and the third portion can be oriented along both the longitudinal direction L and the transverse direction T, and. It should be appreciated that the electrical contacts can alternatively be curved or define any suitable shape. Thus, it can be said that the first portion 104 can extend in a direction having a longitudinal directional component that is greater than the longitudinal directional component than either the second portion 106 (whose longitudinal directional component can be zero), or the third portion. The second portion 106 can extend in a direction having a transverse directional component greater than the transverse directional component than either the first portion 104 (whose transverse directional component can be zero), or the third portion. The third portion can extend in a direction having a transverse directional component greater than the transverse directional component of the first portion 104 (which can have a transverse directional component of zero), and a longitudinal directional component greater than the longitudinal directional component of the second portion 104 (which can have a longitudinal directional component of zero). Alternatively, the electrical contacts 46 can be configured as vertical electrical contacts whereby each of the first, second, and third portions are oriented along the longitudinal direction L. The electrical contacts 46 can define one or more gaps 100 disposed in one or more up to all of the first portion 104, the second portion 106, and the third portion.

For example one or more of a first gap 100*a*, a second gap 100*a*' and a third gap 100*a*" may be created in unassigned electrical contact 46*a* at the first portion 104, the second portion 106, and the third portion, respectively, along the length of the unassigned electrical contact 46*a*. Each gap 100 may have a length 102 and may separate an electrical contact 46 into at least a first portion 104 and a second portion 106 located on opposite sides of the gap 100 along the length of the respective electrical contact 46. For example, the first gap 100*a* may have a first length 102*a* and may separate the respective electrical contact 46*a* into a first portion 104*a* and a second portion 106*a*. Referring still to FIG. 2A, at least one of the gaps 100, such as the gap 100*b*, may be created in one or more, up to all, of signal contacts S, such as electrical contacts 46*b*, in a manner as described above. Thus, respective first and second portions 104*b* and 106*b* may be located on opposite sides of the gap 100*b*.

The gaps 100 may be created in a wide variety of ways as desired. For example, gaps may be created by etching away or cutting a portion of the electrical contact 46. The gaps 100 can be created before or after electrical contacts 46 are overmolded by or otherwise supported by the corresponding leadframe housing 58. Alternatively, the gaps 100 can be created by a process that begins prior to supporting the electrical contacts 46 by the leadframe housing 58, and can be finished after electrical contacts 46 are supported by the leadframe housing 58.

As illustrated in FIGS. 2B and 2C, at least one of the electrical contacts 46 can include an electrical circuit element 108 that is inserted or otherwise disposed in the respective at least one gap 100. For example, one or more up to all of the electrical signal contacts S can contain an electrical circuit element 108 in the respective gap or gaps 100 that is connected between the corresponding first portion 104 and second portion 106 of the electrical signal contact S. In accordance with one embodiment, the circuit element 108 can be connected to each of the first and second portions 104 and 106 across the gap 100. Similarly, one or more up to all of the unassigned electrical contacts U can contain a circuit element 108 in the respective gap or gaps 100 that is connected between the corresponding first portion 104 and second portion 106 of the unassigned electrical contact U. In accordance with one embodiment, the circuit element 108 can be connected to each of the first and second portions 104 and 106 across the gap 100. Thus circuit element 108 may have a length that is longer than the length of the respective gaps 100.

The ground contacts G may include a mating end 48, a mounting end 50, and an intermediate portion 122 that extends continuously from the mating end 48 to the mounting end 50. Stated differently, the intermediate portion 122 of each of the ground contacts G can extend continuously without interruption (e.g., without a gap 100 or a circuit element 108), from the respective mating end 48 to the respective mounting end 50. Thus, it can be stated that the intermediate portion 122 of each of the ground contacts has a constant electrical conductivity from the mating end 48 to the mounting end 50.

In accordance with one embodiment, one or more up to all of the leadframe assemblies 56, including the pluralities of first and second leadframe assemblies 56*a* and 56*b*, can define an opening 112 that extends through the respective leadframe housing 58 along the lateral direction A such that the respective leadframe housing 58 is open to the one or more of the respective gaps 100. The circuit element 108 may also be attached to the first portion 104 and second portion 106 through the opening 112. The attached circuit element 108 may then reside in the opening 112. The opening 112 may provide access to one or more electrical contacts 46. For example, as depicted in FIG. 2A, an opening 112 may provide access to a plurality or electrical contacts 46.

In an embodiment, an exemplary leadframe housing 58 may include a plurality of openings 112 in which individual openings 112 are aligned with the broadside 45 of one or more individual electrical contacts 46 along the row direction. Individual openings 112 may also be aligned with one of the first or second edges 47 of individual electrical contacts 46 along the row direction. For example, individual openings 112 may be aligned with a single contact 46, two contacts 46, or several contacts 46. In an embodiment, the openings 112 are created in the leadframe housing 58 during manufacturing process. Alternatively, the openings 112 can be created in a leadframe housing 58 by, for example, etching, cutting, or drilling away portions of the leadframe housing 58. The openings 112 can be aligned with one or more up to all of the first portion 104, the second portion 106, and the third portion of the respective one or more of the electrical contacts 46.

Each of the circuit elements 108 may be configured as any suitable circuit element as desired, for example, a resistor, a capacitor, or an inductor. In an embodiment, one or more of the signal contacts S and one or more of the unassigned electrical contacts U may have two or more gaps 100 with a circuit element 108 inserted into each gap 100. Thus, one or more of the electrical signal contacts S can include one or more of the circuit elements 108 electrically connected to each other in series along the length of the respective electrical signal contact S. Similarly, one or more of the unassigned electrical contacts U can include one or more of the circuit elements 108 electrically connected to each other in series along the length of the respective unassigned electrical contact U.

As illustrated in FIG. 2B, at least one or more of the unassigned electrical contacts U can include a circuit element 108, such as a resistor, that is inserted or otherwise disposed in the respective at least one or more gaps 100. Thus, the resistor can be electrically coupled to each of the first portion 104 and the second portion 106 at a location between the first portion 104 and the second portion 106, for instance at the third portion. Alternatively, the resistor can be disposed at the first portion 104 or the second portion 106. The electrical contacts 56 may be an unassigned electrical contact U, identified at electrical contact 124. In accordance with one embodiment, first and second resistors 108*a* and 108*d* may be inserted into corresponding gaps 100*a* and 100*d* of respective first and second unassigned electrical contacts U, identified as electrical contacts 46*a* and 46*d*. The first resistor 108*a* may be electrically coupled to first portion 104*a* and second portion 106*a* of the first unassigned electrical contact U, and the second resistor 108*d* may be electrically coupled to first portion 104*d* and second portion 106*d* of the second unassigned electrical contact U. In an embodiment, one or more of the resistors may have a resistance of approximately 50 ohms, or can have any suitable alternative resistance as desired. By inserting a resistor into a corresponding gap 100, the associated electrical contact 46 may no longer be suitable for signal transmission.

With continuing reference to FIG. 2B, a circuit element 108, such as a capacitor, may be inserted into one or more, up to all, of the gaps 100 of signal contacts S. In an embodiment, first and second capacitors 108*b* and 108*c* may be inserted into the gaps 100*b* and 100*c* of respective first and second signal contacts S, respectively, identified at electrical contacts 46*b* and 46*c*. The electrical contacts 46*b* and 46*c* may combine to define a differential signal pair 49, or can be single-ended signal contacts. The first capacitor 108*b* may be electrically coupled to the first portion 104*b* and second portion 106*b* of the first electrical signal contact 46*b*. The second capacitor 108*c* may be electrically coupled to the first portion 104*c* and second portion 106*c* of the second electrical contact signal 46*c*.

Thus, the first electrical connector 22 can include at least one pair of electrical signal contacts S, which can define a differential signal pair, and at least one select electrical contact, which can be an unassigned electrical contact U, another electrical signal contact S, or a ground contact G as desired. At least one or both of the electrical signal contacts S of the pair of electrical signal contacts S includes the first portion 104 that carries the mating end, the second portion 106 that carries the mounting end, and a capacitor electrically coupled between the first and second portions 104 and 106. The at least one select electrical contact also includes the first portion 104, the second portion 106, and a resistor electrically coupled between the first and second portions.

As illustrated in FIG. 2C, a first resistor 108*e* can be inserted or otherwise disposed in a gaps 100*e* of a first unassigned electrical contact U, identified at electrical contact 46*e*. A second resistor 108*e* can be inserted or otherwise disposed in a second gap 100*e* of a second unassigned electrical contact U, identified at electrical contact 46*f*. The first resistor 108*e* may be electrically coupled to first portion 104*e* and second portion 106*e* of the first electrical contact 46*e*. Similarly, the resistor 108*f* may be electrically coupled to first portion 104*f* and second portion 106*f* of the second electrical contact 46*f*.

With continuing reference to FIG. 2C, a first capacitor 108*g* can be inserted into or otherwise disposed in a respective gaps 100*g* of a respective first electrical signal contact S identified at electrical contact 46*g*. Similarly, a second capacitor 108*g* can be inserted into or otherwise disposed in a respective gaps 100*g* of a respective second electrical signal contact S identified at electrical contact 46*h*. The first and second electrical contacts 46*g* and 46*h* can combine to define a differential signal pair 49, or can be single-ended signal contacts as desired. The capacitor first 108*g* may be electrically coupled to the first portion 104*g* and second portion 106*g* of the first electrical contact 46*g*. Similarly, the second capacitor 108*h* may be electrically coupled to the first portion 104*h* and second portion 106*h* of the second electrical contact 46*h*.

In one embodiment, one or more, up to both, signal contacts of respective signal contact pairs 114 can include a first portion 104 that carries a mating end 48, a second portion 106 that carries a mounting end 50, and a respective circuit element 108, such as a capacitor, electrically coupled between the first portion 104 and the second portion 106. The signal contact pair 114 may define a differential signal pair 49. The differential signal pair 49 may be edge coupled or broadside coupled along the column direction 53. For example, electrical signal contacts identified at electrical contacts 46*g* and 46*h* may comprise a differential signal pair 49. The electrical contact 46*g* can include a first portion 104*g*, a section portion 106*g*, and a capacitor electrically connected to each of the first and second portions 104*g* and 106*g*, respectively. Similarly, the electrical contact 46*h* can include a first portion 104*h*, a section portion 106*h*, and a capacitor electrically connected to each of the first and second portions 104*h* and 106*h*, respectively.

Figure 3A:
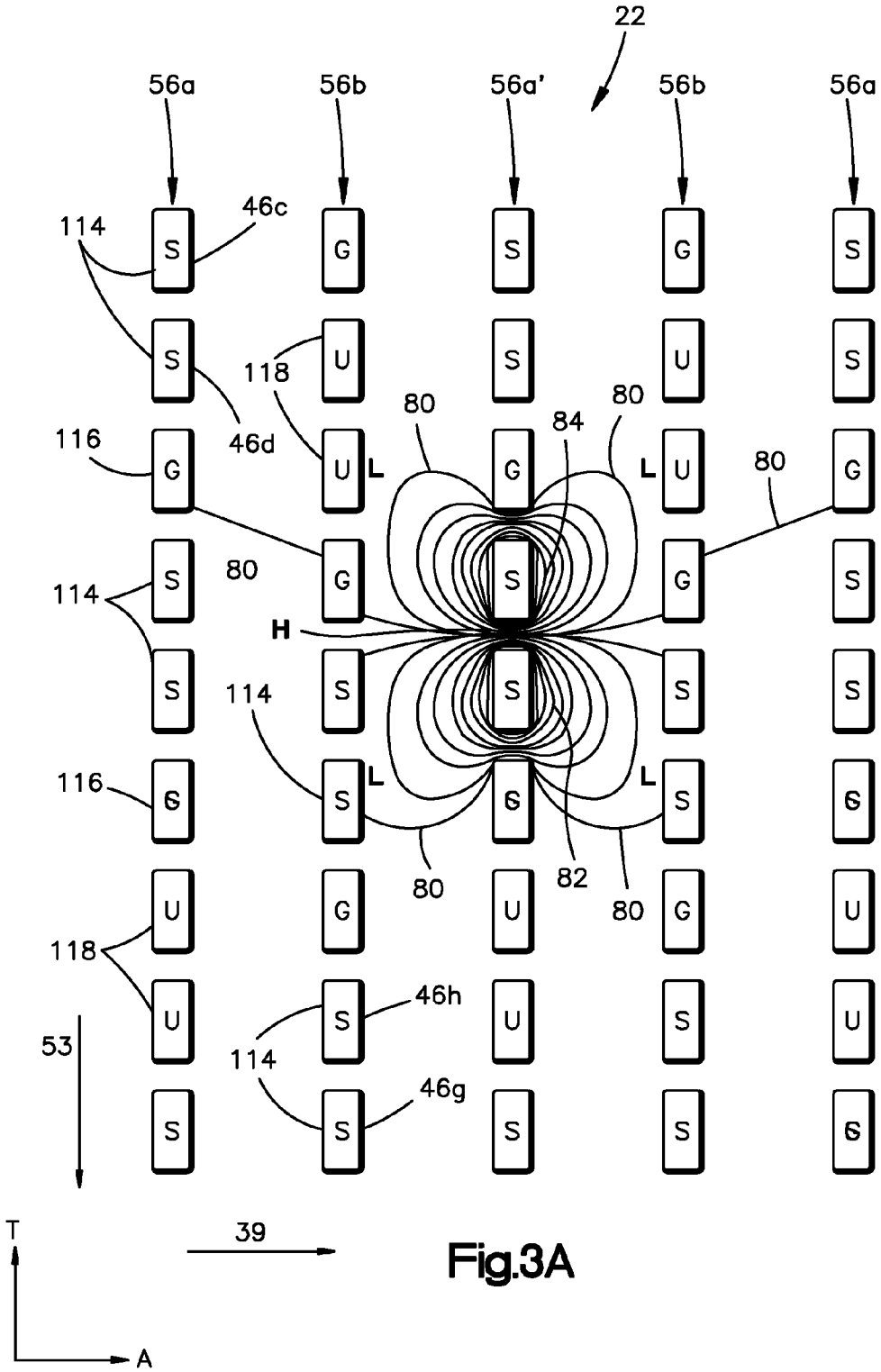
FIG. 3A is a schematic view of a mating interface of a first electrical connector, showing electrical fields during operation of the first electrical connector.

Referring to FIG. 3A, the mating interface 48 of the first electrical connector 22' can include respective first and second leadframe assemblies 56*a* and 56*b* arranged in an alternating order along the row direction 39 as described above. As depicted in FIG. 3A, the electrical connector 22 may contain a plurality of electrical contacts 46 arranged into a plurality of columns that extend in the column direction 53, and a plurality of rows that extend in the row direction 39 that is perpendicular to the column direction 53. The column direction 53 can be in the transverse direction T, and the row direction can be in the lateral direction A. The electrical contacts 46 can include one or more, up to all, of the following: at least one pair of electrical signal contacts S, as identified at 114. The electrical contacts 46 can further include at least one ground contact G, as identified at 116. The electrical contacts 46 can include at least one unassigned electrical contact U, as identified at 118. The pairs 114 of adjacent ones of the signal contacts 114, for instance with respect to the column direction 53, can define differential signal pairs, or the signal contacts S can be single ended as desired.

As described above with respect to FIGS. 2A-2C, one or both of the signal contacts S of one or more, up to all, of the differential signal pairs 114 may include the first portion 104 that carries the mating end 48, the second portion 106 that carries the mounting end 50, and the respective circuit element 108 electrically coupled between the first portion 104 and the second portion 106.

Further, one or more, up to all, of the unassigned electrical contacts 118 of electrical connector 22 may also include the first portion 104, the second portion 106, and a circuit element 108, for instance a resistor, that is electrically coupled between the first portion 104 and the second portion 106. The first leadframe assembly 56*a* may contain one or more electrical contacts 118 that are unassigned. For example, the first leadframe assembly 56*a* may include a pair of electrical contacts 118 that are adjacent each other along the column direction 53, and can each define the first portion 104, the second portion 106, and a respective circuit element 108, which can be defined as a resistor, electrically coupled between corresponding the first portion 104 and second portion 106.

One or more, up to all, of the ground contact 116 of the electrical connector 22 may include a mating end 48, a mounting end 50, and an intermediate portion 122 that extends continuously from the mating end 48 to the mounting end 50. Stated differently, the intermediate portion 122 (see FIG. 2B) that may extend, continuously without interruption (e.g., without a gap 100 or a circuit element 108), from the mating end 48 to the mounting end 50. Thus, it can be stated that the ground contacts 116, and thus intermediate portion 122, has a substantially constant electrical conductivity from the mating end 48 to the mounting end 50.

Figure 3B:
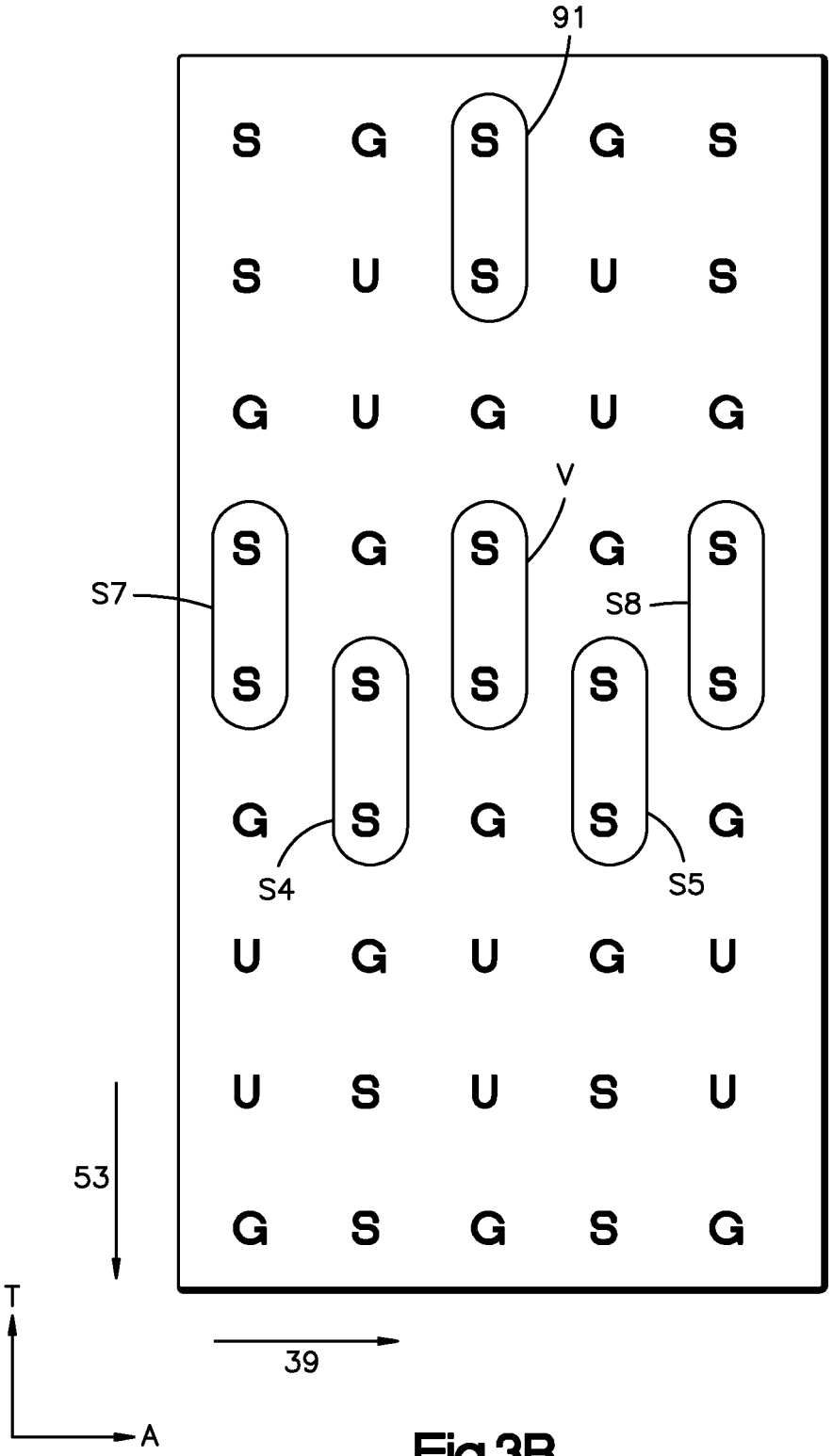
FIG. 3B is a map of the mating interface illustrated in FIG. 2A, illustrating a victim signal pair, at least one aggressor signal pair, and a pair unassigned electrical contacts.

Referring now to FIG. 3B the schematic representation of FIG. 3A illustrates cross talk from a plurality of aggressor differential signal pairs to a victim differential signal pair of the electrical connector. Cross talk from each of six aggressor differential pairs of electrical contacts 46 (also known as attacking pairs) S1, S4, S5, S7, and S8 can impact "victim" differential pair of electrical contact signals V. The combined cross talk from the aggressor pairs can be determined by, for example, summing the absolute values of the peak cross talk from each of the pairs, which assumes that each pair is fairing at the highest level all at the same time. Thus, it should be understood that this is a worst case scenario, and that, in practice, much better results can be achieved. It should be understood that although pair V is considered to be a victim pair, pair V also imparts cross talk onto each of pairs S1, S4, S5, S7, and S8. Thus, pair V is a victim pair and an aggressor pair. Similarly, each of the differential pairs 49 of signal contacts S may be considered aggressor pair and a victim pair. Further, each unassigned electrical contact U may be considered a victim and each pair of unassigned electrical contacts U may be considered a victim pair.

Referring again to FIG. 3A, an example contour plot, containing contour lines 80, of voltage in the neighborhood of an active column-based differential signal pair in a contact matrix of signal contacts S, ground contacts G, and unassigned electrical contacts U. It has also been found that a number of factors can affect the level of cross talk between adjacent signal contacts. A number of such factors are described in detail below, though it is anticipated that there may be others. Additionally, though it is preferred that all of these factors be considered, it should be understood that each factor may, alone, sufficiently limit cross talk for a particular application. Any or all of the following factors may be considered in determining a suitable contact arrangement for a particular connector design:

Less cross talk has been found to occur where adjacent contacts are edge-coupled (i.e., where the edge of one contact is adjacent to the edge of an adjacent contact) than where adjacent contacts are broad side coupled (i.e., where the broad side of one contact is adjacent to the broad side of an adjacent contact) or where the edge of one contact is adjacent to the broad side of an adjacent contact. The less the distance between opposed edges of the electrical signal contacts of a differential signal pair, the less that differential signal pair's electrical field will extend towards an adjacent pair, and thus the more that the electrical connector 22 can deviate from the unity height-to-width ratio of the original I-shaped theoretical model. Edge coupled signal contacts also allows for smaller gap lengths between adjacent connectors, and thus facilitates the achievement of desirable impedance levels in high contact density connectors without the need for contacts that are too small to perform adequately. For example, it has been found that a gap of about 0.3-0.4 mm is adequate to provide an impedance of about 100 ohms where the contacts are edge coupled, while a gap of about 1 mm is necessary where the same contacts are broad side coupled to achieve the same impedance. Edge coupling also facilitates changing contact width, and therefore the gap length, as the contact extends through dielectric regions, contact regions, etc.;

It has also been found that cross talk can be effectively reduced by varying the "aspect ratio," i.e., the ratio of column pitch (i.e., the distance between adjacent columns) to the gap between adjacent contacts in a given column;

Furthermore, staggering the electrical signal contacts of adjacent columns relative to one another, for instance along the transverse direction T, can also reduce the level of cross talk. That is, cross talk can be effectively limited where the signal contacts in a first column are offset relative to adjacent signal contacts in an adjacent column along the transverse direction. The amount of offset may be, for example, a full row pitch (i.e., distance between adjacent rows), half a row pitch, or any other distance that results in acceptably low levels of cross talk for a particular connector design. It has been found that the desired offset depends on a number of factors, such as column pitch, row pitch, the shape of the terminals, and the dielectric constant(s) of the insulating material(s) around the terminals, for example. The desired offset may be anywhere along a continuum, and is not limited to whole fractions of a row pitch (e.g., full or half row pitches).

The unassigned electrical contacts U which, as described above, may contain a resistor, can reduce unwanted spikes in insertion loss at a resonance frequency. Without being bound by theory, it is believed each of the one or more unassigned electrical contacts U dissipate energy which would otherwise be reflected back, thereby exacerbating resonance. Thus, the addition of unassigned electrical contacts U reduces the magnitude of the resonance effect between differential signal pairs (such as aggressor and victim pairs). The unassigned electrical contacts U can also reduce resonant crosstalk. The unassigned electrical contacts U can also reduce conversion spikes. Thus, the unassigned electrical contacts can lower the quality factor Q of the resonance, thereby improving both insertion loss and crosstalk performance.

For instance, it should be appreciated that the unassigned electrical contacts U can reduce a magnitude of the resonance between differential signal pairs in, for example, the first electrical connector 22. The unassigned electrical contacts U can include one or more resistors, one or more capacitors, one or more inductors, or combinations thereof, as described above. The electrical connector 12 may further select signal contacts S that include one or more capacitors, as described above. For example, the electrical connector 12 can include a leadframe assembly 56 having a plurality of electrical contacts 46 supported by the respective leadframe housing 58 and arranged along the column direction 53 and thus spaced from each other along the column direction 53. The plurality of electrical contacts 46 of the leadframe assembly 56 can include at least one pair of electrical signal contacts and at least one select electrical contact. At least one of the electrical signal contacts of the pair of electrical signal contacts can include a first gap that separates the at least one of the electrical signal contacts of the pair of electrical signal contacts into a first portion and a second portion, the first portion carrying a mating end and the second portion carrying a mounting end. The at least one of the electrical signal contacts of the pair of electrical signal contacts can include a capacitor disposed in the first gap, the capacitor being electrically coupled to the first and second portions. The at least one of the electrical signal contacts of the pair of electrical signal contacts can further define a second gap that separates the at least one select electrical contact into a first portion and a second portion, and a resistor disposed in the second gap and electrically coupled between the respective first and second portions.

In accordance with one embodiment, a method can be provided for reducing spikes in insertion loss resonance frequencies of an electrical connector. The method can include the step of providing or teaching the use of an electrical connector that includes a connector housing, and a plurality of leadframe assemblies, such as the first and second leadframe assemblies 56*a* and 56*b*, supported by the connector housing 30 and spaced from each other along the row direction. Each leadframe assembly 56 including a leadframe housing 58 and a plurality of electrical contacts 46 supported by the leadframe housing 58. The method may further include teaching the step of identifying an unassigned electrical contact U of the plurality of electrical contacts 46 and the step of separating first portions 104 and second portions 106 of the identified unassigned electrical contact U. The method may further include teaching the step of placing a resistor in electrical communication with each of the first portion 104 and second portion 106. The method may further teach the step of separating the identified an unassigned electrical contact U at a location in alignment with an opening 112 that extends through the leadframe housing along the row direction. The method may also include selling to the third party the electrical connector or purchasing the electrical connector from the third party.

Additionally, a method can be provided for reducing spikes in insertion loss resonance frequencies of an electrical connector can further include teaching the step of separating signal contacts into a first and second portions and placing a capacitor in electrical communication with each of the first and second portions.

Referring again to FIGS. 1A-B, the second electrical connector 26 includes a dielectric connector housing 31 and a plurality of electrical contacts 33 that are supported by the connector housing 31. The electrical contacts can include signal contacts and ground contacts. The second electrical connector 26 defines a mating interface 61 configured to mate with the mating interface 42 of the first electrical connector 22 when the first and second electrical connectors 22 and 26 are mated. The second electrical connector further defines a mounting interface 63 that is configured to operatively engage the second substrate 28. As shown, the second electrical connector 26 can be a vertical electrical connector, whereby the mating interface 61 and the mounting interface 63 are oriented substantially parallel to each other, and the electrical contacts 33 can be vertical electrical contacts. It should be appreciated that the second electrical connector 26 can alternatively be a right-angle connector whereby the mating interface 61 and the mounting interface 63 are oriented substantially perpendicular to each other, and the electrical contacts 33 are right-angle electrical contacts.

The electrical contacts 33 may be insert molded into the connector housing 31 prior to attachment to the connector housing 31, stitched into the connector housing 31, or otherwise supported by the connector housing 31. Alternatively, the electrical contacts 33 can be arranged in respective leadframe assemblies in the manner described above with respect to the first electrical connector 22. The electrical contacts 33 define respective mating ends 65 that extend along the mating interface 61, and mounting ends 67 that extend along the mounting interface 63. Each of the electrical contacts 33 can define respective first and second opposed broadsides 69 and first and second edges 71 connected between the broadsides 69. The edges 71 define a length less than that of the broadsides 69, such that the electrical contacts 33 define a rectangular cross section. The mounting ends 67 may be press-fit tails, surface mount tails, or fusible elements such as solder balls, which are configured to electrically connect to a complementary electrical component such as the second substrate 28, which can be configured as a backplane, midplane, daughtercard, or the like.

At least one or more pairs of adjacent electrical contacts 33 can be configured as differential signal pairs 73, or can be single-ended as desired. In accordance with one embodiment, the differential signal pairs 73 are edge coupled, that is the edges 71 of each electrical contact 33 of a given differential signal pair 73 face each other along a common column 75 that extends in the transverse direction T. Thus, the second electrical connector 26 can include a plurality of differential signal pairs 73 arranged along respective column 75. The second electrical connector 26 can include any number of differential signal pairs 73 as desired that can be positioned edge-to-edge along the respective common column 75.

In accordance with another embodiment, the differential signal pairs 73 are may be broadside coupled, that is the broadsides 69 of each electrical contact 33 of a given differential signal pair 73 face each other along a common column 75 that extends in the transverse direction T. Thus, the second electrical connector 26 can include a plurality of differential signal pairs 73 arranged along respective column 75. The second electrical connector 26 can include any number of differential signal pairs 73 as desired that can be positioned edge-to-edge along the respective common column 75.

Because the mating ends 65 of the electrical contacts 33 are configured as plugs that are configured to be received by the mating ends 48 of the electrical contacts of the first complementary electrical connector 22 when the first and second electrical connectors 22 and 26 are mated, the second electrical connector 26 can be referred to as a plug or header connector. Alternatively, the second electrical connector 26 can be provided as a receptacle connector whereby the mating ends 65 are configured to receive plugs of a complementary electrical connector that is to be mated with the second electrical connector 26.

One or both of the first and second electrical connectors 22 and 26 may be shieldless high-speed electrical connectors, i.e., connectors that are devoid of metallic crosstalk plates between the electrical contacts 46 of the adjacent leadframe assemblies 56. Alternatively, one or both of the first and second electrical connectors 22 and 26 can include a metallic or alternatively constructed electrically conductive shield that includes ground mounting ends and ground mating ends in place of the ground contacts G, as described in U.S. Pat. No. 8,366,485, the disclosure of which is hereby incorporated by reference as if set forth in its entirety herein. It should be appreciated that the electrical contacts 33 of the second electrical connector 26 can include one or more gaps 100 and corresponding circuit elements 108 in the manner described above with respect to the first electrical connector 22 as desired.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, those skilled in the art will realize that the invention is intended to encompass all modifications and alternative arrangements included within the spirit and scope of the invention, for instance as set forth by the appended claims.

What is claimed:

1. An electrical connector configured to transmit electrical signals, the electrical connector comprising:

an electrically insulative connector housing; and a plurality of electrical contacts supported by the connector housing, the electrical contacts arranged in a plurality of rows that extend along a row direction, and a plurality of columns that extend along a column direction that is substantially perpendicular to the row direction;

wherein the plurality of electrical contacts include a plurality of ground contacts, each of the ground contacts including a mating end, a mounting end, and an intermediate portion that extends continuously from the mating end to the mounting end such that no circuit element is carried by the ground contacts, and wherein 1) the plurality of electrical contacts further includes at least one pair of electrical signal contacts and at least one pair of unassigned electrical contacts between ones of the ground contacts along the column direction, 2) at least one of the electrical signal contacts of the pair of electrical signal contacts includes a first portion that carries a mating end, a second portion that carries a mounting end, and a capacitor electrically coupled between the first and second portions, 3) each unassigned electrical contact includes a first portion, a second portion, and a resistor electrically coupled between the first and second portions, and 4) the unassigned electrical contacts of the at least one pair are adjacent each other along the column direction.

2. The electrical connector as recited in claim 1, further comprising a plurality of leadframe assemblies supported by the connector housing, each of the plurality of leadframe assemblies including an electrically insulative leadframe housing, and select ones of the plurality of electrical contacts.

3. The electrical connector as recited in claim 2, wherein the at least one pair of electrical signal contacts and the at least one pair of unassigned electrical contacts are supported by the same one of the leadframe housings.

4. The electrical connector as recited in claim 2, wherein the at least one pair of electrical signal contacts and the at least one pair of unassigned electrical contacts are supported by different ones of the leadframe housings.

5. The electrical connector as recited in claim 2, wherein the leadframe assemblies are spaced from each other along the row direction.

6. The electrical connector as recited in claim 5, wherein at least one of the leadframe assemblies defines a gap that extends through the respective leadframe housing in alignment with the resistor of each of the unassigned electrical contacts along the row direction.

7. The electrical connector as recited in claim 1, wherein the electrical signal contacts of the pair define a differential signal pair.

8. The electrical connector as recited in claim 7, wherein the electrical signal contacts of the pair are edge coupled along the column direction.

9. The electrical connector as recited in claim 1, wherein the intermediate portion has a substantially constant electrical conductivity from the mating end to the mounting end.

10. An electrical connector configured to transmit electrical signals, the electrical connector comprising:

an electrically insulative connector housing; and a plurality of electrical contacts supported by the connector housing, the electrical contacts arranged in a plurality of rows that extend along a row direction, and a plurality of columns that extend along a column direction that is substantially perpendicular to the row direction, wherein the plurality of electrical contacts includes a plurality of electrical signal contacts and a pair of unassigned electrical contacts between ones of ground contacts along the column direction, each unassigned electrical contact in the pair adjacent each other along the column direction, and only each unassigned electrical contact of the plurality of electrical contacts includes a first portion, a second portion, and a resistor electrically coupled between the first and second portions.

11. The electrical connector as recited in claim 10, wherein the plurality of electrical contacts includes the ground contacts, and each of the ground contacts include a mating end, a mounting end, and an intermediate portion that extends continuously from the mating end to the mounting end such that no circuit element is carried by the ground contacts.

12. The electrical connector as recited in claim 10, wherein the plurality of electrical signal contacts are arranged in differential signal pairs along the column direction.

13. A leadframe assembly comprising:

an electrically insulative leadframe housing; and a plurality of electrical contacts supported by the leadframe housing, each of the plurality of electrical contacts arranged in a column and spaced from each other along a column direction, wherein the plurality of electrical contacts include a plurality of ground contacts including a mating end, a mounting end, and an intermediate portion that extends continuously from the mating end to the mounting end such that no circuit element is carried by the ground contacts, and wherein 1) the plurality of electrical contacts includes at least one pair of electrical signal contacts and at least one pair of unassigned electrical contacts that are adjacent to each other and disposed between ones of the ground contacts, 2) each electrical signal contact of the pair of electrical signal contacts includes a first portion that carries a mating end, a second portion that carries a mounting end, and a respective capacitor electrically coupled between the first and second portions, and 3) each unassigned electrical contact of the at least one pair of unassigned electrical contacts includes a first portion, a second portion, and only a resistor electrically coupled between the first and second portions.

14. The leadframe assembly as recited in claim 13, wherein the at least one pair of electrical signal contacts defines a differential signal pair.

15. A leadframe assembly comprising:

an electrically insulative leadframe housing; and a plurality of electrical contacts supported by the leadframe housing, each of the plurality of electrical contacts arranged in a column and spaced from each other along a column direction, wherein the plurality of electrical contacts includes a plurality of electrical signal contacts and a pair of unassigned electrical contacts between ones of ground contacts along the column direction, each unassigned electrical contact in the pair adjacent to each other along the column direction, and only each unassigned electrical contact of the plurality of electrical contacts includes a first portion, a second portion, and a resistor electrically coupled between the first and second portions.

16. The leadframe assembly as recited in claim 15, wherein the plurality of electrical contacts includes the ground contacts, and each of the ground contacts include a mating end, a mounting end, and an intermediate portion that extends continuously from the mating end to the mounting end such that no circuit element is carried by the ground contacts.

17. The leadframe assembly as recited in claim 15, wherein the plurality of electrical signal contacts are arranged in different signal pairs along the column direction.

18. A method of reducing insertion loss spikes of an electrical connector, the method comprising the steps of:

receiving an electrically insulative leadframe housing, the electrically insulative housing comprising a plurality of electrical contacts supported by the leadframe housing, each of the plurality of electrical contacts arranged in a column and spaced from each other along a column direction, wherein the plurality of electrical contacts includes at least one pair of electrical signal contacts and at least one pair of unassigned electrical contacts that are adjacent to each other;

defining a plurality of ground contacts of the plurality of electrical contacts, such that the at last one pair of unassigned electrical contacts are between ones of the ground contacts;

creating a first gap in at least one of the electrical signal contacts of the pair of electrical signal contacts, the first gap separating the at least one of the electrical signal contacts of the pair of electrical signal contacts into a first portion and a second portion, the first portion carrying a mating end and the second portion carrying a mounting end;

inserting a capacitor into the first gap, the capacitor being electrically coupled to the first and second portions;

creating a second gap in each of the unassigned electrical contacts, the second gap separating the respective unassigned electrical contact into a first portion and a second portion; and inserting only a resistor into the second gap of each of the unassigned electrical contacts, the resistor being electrically coupled between the first and second portions.

19. The method as recited in claim 18, further comprising the step of defining a gap that extends through the leadframe housing in alignment with the resistor of each unassigned electrical contact along a row direction perpendicular to the column direction.

20. The method as recited in claim 18, wherein the electrical signal contacts of the pair define a differential signal pair.

21. The method as recited in claim 18, wherein the electrical contacts include at least one ground contact, the ground contact including a mating end, a mounting end, and an intermediate portion that extends continuously from the mating end to the mounting end.

22. A method of reducing insertion loss spikes of an electrical connector, the method comprising the steps of:

identifying a pair of unassigned electrical contacts among a plurality of electrical contacts supported by an electrically insulative leadframe housing and spaced from each other along a column direction, such that the unassigned electrical contacts in the identified pair are adjacent to each other;

identifying a pair of ground contacts among the plurality of electrical contacts, such that the pair of unassigned electrical contacts are between the pair of ground contacts;

creating a gap in each of the unassigned electrical contacts, the gap separating the respective unassigned electrical contact into a first portion and a second portion; and inserting only a resistor into the gap, so as to electrically couple the resistor to each of the first and second portions.

23. The method as recited in claim 22, wherein each of the ground contacts include a mating end, a mounting end, and an intermediate portion that extends continuously from the mating end to the mounting end.

* * * * *